United States Patent [19]

Chou

[11] Patent Number: 4,669,695

[45] Date of Patent: Jun. 2, 1987

[54] APPLIANCE ANTI-TIP SYSTEM

[75] Inventor: Robert V. Chou, Prospect, Ky.

[73] Assignee: General Electric Company, Louisville, Ky.

[21] Appl. No.: 830,365

[22] Filed: Feb. 18, 1986

[51] Int. Cl.[4] ..... A47B 97/00

[52] U.S. Cl. ..... 248/500; 248/680; 248/154; 248/224.4

[58] Field of Search ..... 248/673, 680, 501, 154, 248/258, 673, 674, 300, 503, 224.4, 500; 312/245, 250, 239

[56] References Cited

U.S. PATENT DOCUMENTS

| | | | |
|---|---|---|---|
| 989,085 | 4/1911 | Turton | 248/680 |
| 2,124,541 | 7/1938 | Cassey | 248/223.4 |
| 2,537,050 | 1/1951 | Gluck | 248/224.4 |
| 2,576,865 | 11/1951 | Vanderveld | 248/243 |
| 2,709,494 | 5/1955 | Luce | 248/300 |
| 3,084,211 | 4/1963 | Rapata | 248/507 |
| 3,114,364 | 12/1963 | Cullen et al. | 126/191 |
| 3,453,779 | 7/1969 | Reifenberg | 49/386 |
| 3,912,350 | 10/1975 | Gurubatham | 312/276 |
| 3,966,158 | 6/1976 | Boundy | 248/243 |
| 4,270,821 | 6/1981 | Verdesca | 312/245 |

*Primary Examiner*—Reinaldo P. Machado
*Assistant Examiner*—Alvin Chin-Shue
*Attorney, Agent, or Firm*—Radford M. Reams

[57] ABSTRACT

An apparatus for preventing tilting of an appliance relative to a wall including a pair of rigid support members mountable on the wall which cooperatively engage stop means on the appliance when it is positioned adjacent the wall. Each support member includes a first portion secured to the wall with a plurality of fasteners such that the rear face thereof firmly engages the wall, and a second portion extending substantially perpendicular to the first portion including stop means. Openings in the rear wall of the appliance include second stop means which are aligned with the stop means on the second portion of the support member when the appliance is positioned adjacent the wall to thereby prevent tilting of the appliance.

5 Claims, 3 Drawing Figures

APPLIANCE ANTI-TIP SYSTEM

BACKGROUND OF THE INVENTION

This invention relates to a means for preventing accidental tip-over of a free-standing structure such as, for example, a home appliance.

Many free-standing structures, particularly in the field of home appliances, are provided with access openings in a side wall and a closure member, or door, for the access opening. Most often the door is hinged at its bottom edge and pivots substantially 90° to an essentially horizontal open position. When in the open position, the door may be at a height from several inches to a foot above floor level. This height makes it possible for even a small child to climb or sit upon the door. The weight of the child may be sufficient to shift the center of gravity of the appliance to an extent whereupon the structure will tip over. This obviously could result in damage to the appliance and, more importantly, serious injury to the child. Tip-over may also be caused by setting upon the open door objects which are to be eventually inserted into the appliance or which are being removed. The problem of tip-over is not limited to an arrangement wherein the door opens to a horizontal position since a child may attempt to swing on a vertically hinged door. The problem of tip-over could be overcome by securing the appliance to the floor or other solid structuring; however, there are many occasions when it is either impossible or undesirable to secure the appliance in such a manner. For example, one would not want to secure a free-standing appliance in such a manner since this would defeat its ability to be moved for cleaning and repair. Tip-over could also be minimized by extending outrigging from the appliance; however, this would result in excessive consumption of floor space and would present an unattractive appearance. It, therefore, would be desirable to provide, in a free-standing structure having a door on its side wall, anti-tip means to prevent tip-over of the structure without excessive consumption of floor space and which is not unattractive.

SUMMARY OF THE INVENTION

Accordingly, it is an object of this invention to provide an improved anti-tip arrangement for a free-standing structure.

It is another object of this invention to provide an improved anti-tip arrangement for a free-standing structure which does not consume unnecessary floor space.

It is another object of this invention to provide an improved anti-tip arrangement particularly adapted for use with a free-standing structure having a closure member.

An apparatus for preventing tilting of an appliance relative to a wall wherein the appliance is provided with a receiving aperture on its rear wall. A rigid support member is provided which includes a first wall engaging portion having a substantially flat rear side, and a second portion extending substantially perpendicular from the first portion which includes a stop portion on the lower edge thereof. The first portion is secured to the wall by a plurality of fasteners which extend therethrough and into said wall. The appliance receiving aperture includes a support portion on the lower end of the opening which engages the stop portion on the second portion of the support member to thereby prevent tilting of the appliance relative to the wall.

DESCRIPTION OF THE PREFERRED EMBODIMENT

Figure 1:
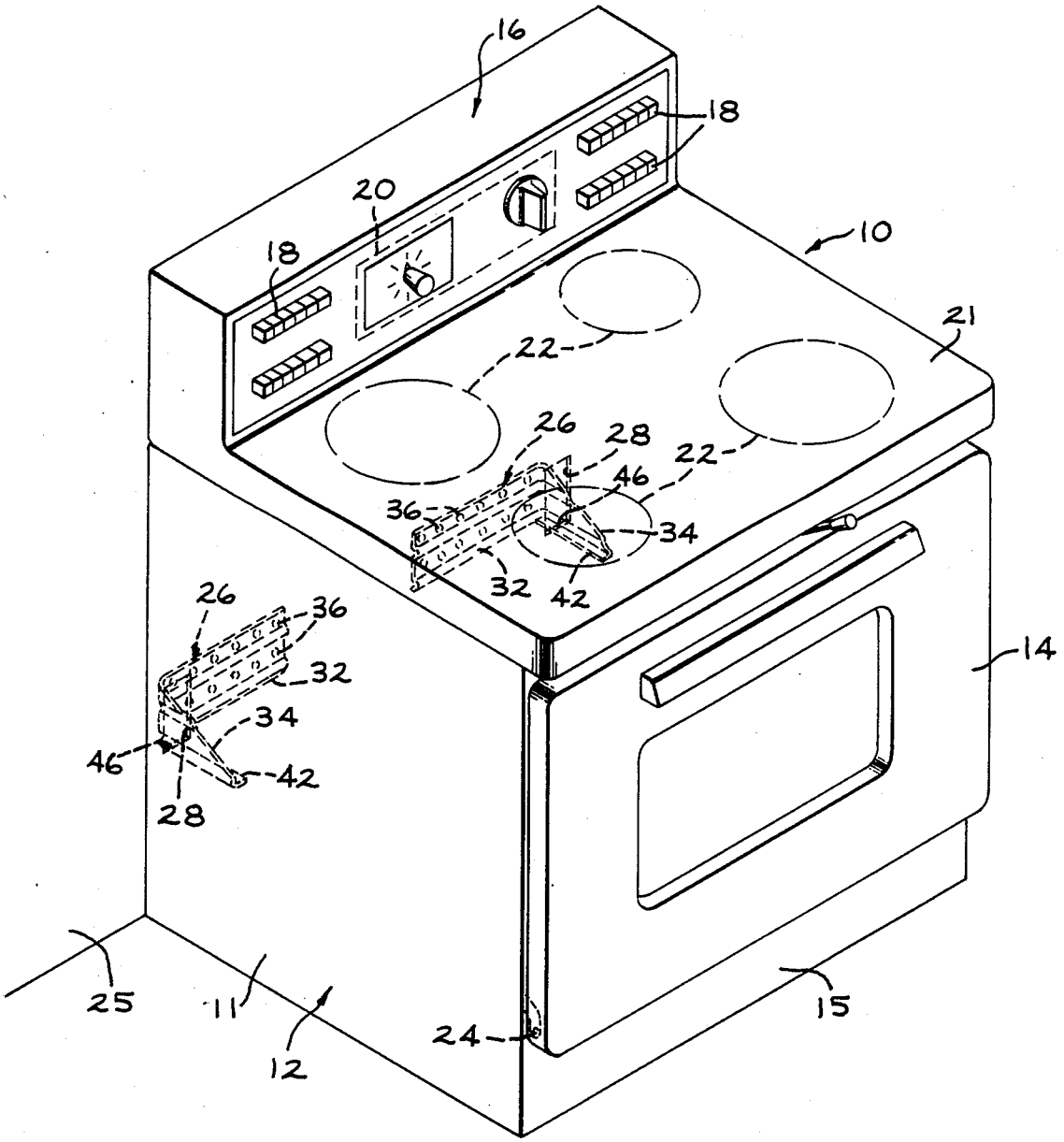
FIG. 1 is a perspective view showing a cooking range including the associated anti-tilt means in accordance with the present invention.

Referring now to the drawings, and particularly to FIG. 1, there is illustrated a free-standing cooking appliance 10 having an outer cabinet 12 including side walls 11, a rear wall 13 (FIGS. 2 and 3) and a front wall 15. The front wall 15 is provided with a closure member or door 14. It should be noted at the outset that the present invention is not limited in its application to a cooking appliance but, as pointed out above, may be employed with any free-standing cabinet structure. The application of the present invention in a cooking appliance is for purposes of illustration only.

The cooking appliance, as shown, includes a control panel 16 in which is disposed the appropriate control switches 18, a timer 20, and other components (not shown) necessary to provide selected cooking functions. The cooking surface or top wall 21 of the cabinet 12 is provided with surface cooking units 22 which are shown diagrammatically in FIG. 1. Disposed within the cabinet 12 and spaced from the cabinet outer walls is an oven cavity 23 (FIG. 2) and conventional heating elements (not shown) and, since they do not form a part of the present invention, their structure and function will not be discussed. The door 14 in the present instance is pivoted about point 24 adjacent its bottom edge.

In accordance with the present invention, there is provided means to prevent tip-over of the cabinet structure which is automatically operative when the cabinet is arranged with its rear wall 13 adjacent a wall 25, as shown in FIG. 1. To this end a system is provided that includes a pair of brackets or members 26 which are adapted to be mounted on the wall 25 and cooperating holding or receiving apertures 28 formed on the rear wall 13 of the appliance cabinet 12. While in the present embodiment of the invention as shown, two brackets are employed. It should be understood that a single bracket may be employed in carrying out the function of the present invention.

Figure 2:
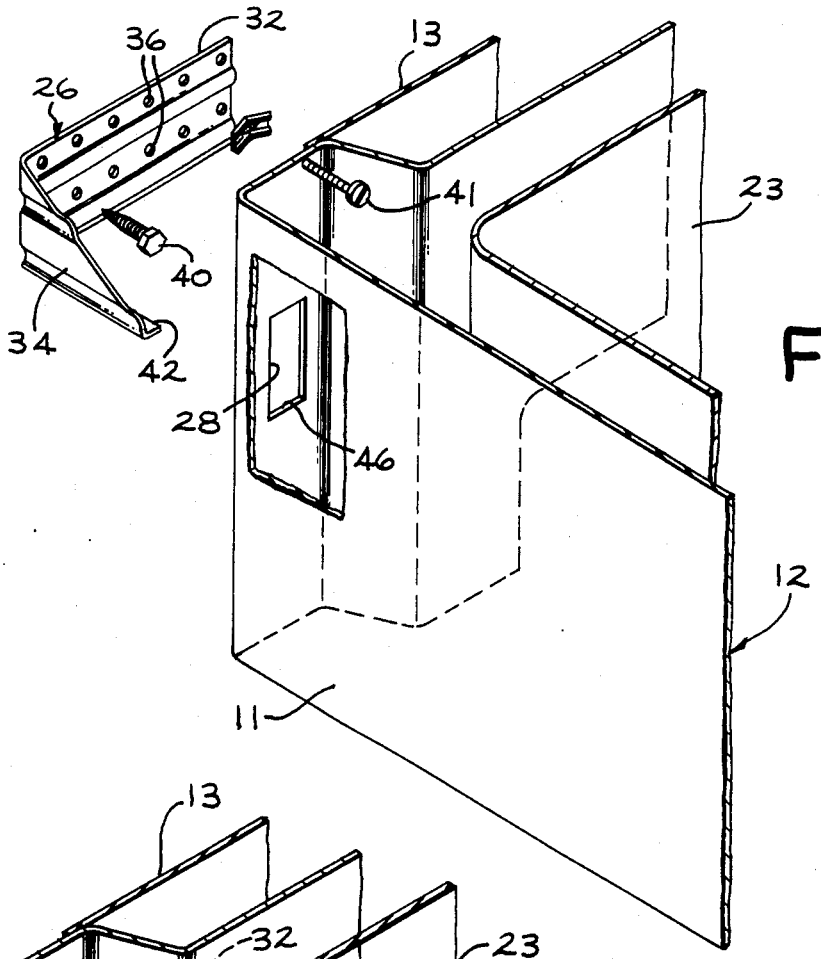
FIG. 2 is a fragmentary perspective view showing the associated anti-tilt components of the present invention prior to cooperative assembly.
Figure 3:
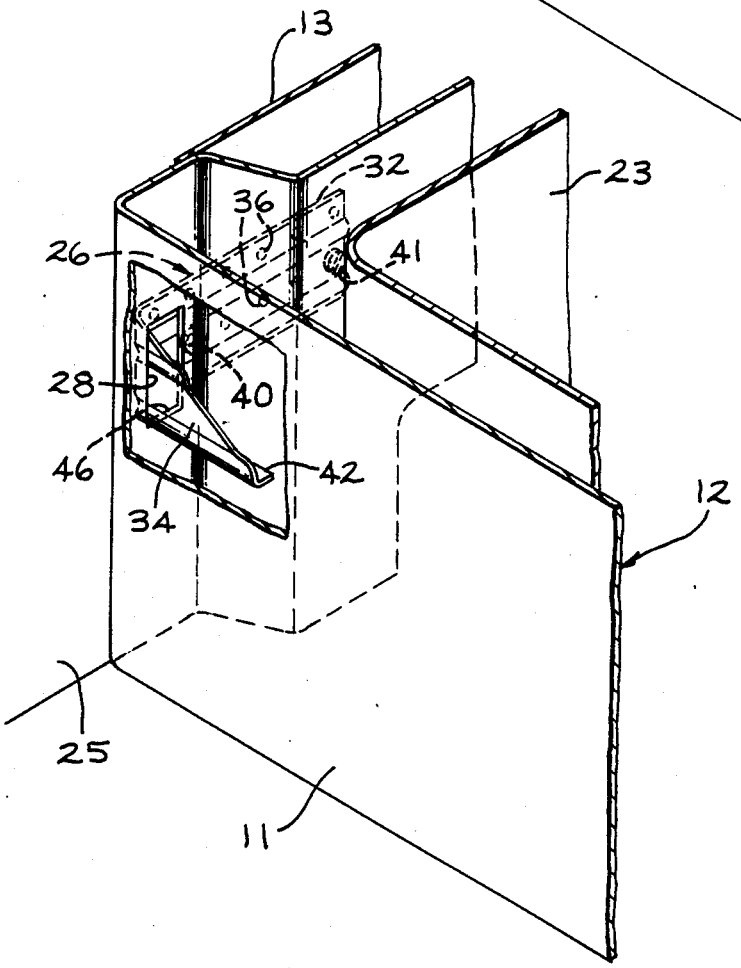
FIG. 3 is a fragmentary perspective similar to FIG. 2 showing the associated anti-tilt oomponents in their cooperative relationship.

The brackets 26 as shown are formed to include a first substantially flat portion 32 which is adapted to be secured to the wall 25 in a manner to be explained hereinafter and a second portion 34 extending substantially perpendicular thereto. The portion 32 includes a pair of substantially parallel rows of horizontally extending holes 36 through which fasteners 40 may be positioned in securing the bracket 26 to the wall 25. The length of portion 32 and the spacing of the holes 36 are selected so as to enhance the likelihood that a stud or other vertical support structure in the wall will be engaged by a fastener 40 when the bracket is at a selected location in which the appliance is to be positioned relative to the wall 25. In residences using hollow wall construction it is standard practice for vertical wall frame members or studs (not shown) to be spaced 16" on center. Accordingly, the portion 32 of brackets 26 in the present instance have a length of approximately 18". This insures that the bracket portion 32 bridges the space between wall studs and that it will be secured to at least one wall stud. In the area where a stud is not encountered, toggle or expandable fasteners 41 as shown in FIG. 2 may be employed when the system is applied to hollow walls. The lower end of portion 34 of bracket 26 includes inwardly turned flange 42 forming a stop surface on the underside thereof. For easy insertion of portion 34 into the opening 28, the bottom edge of portion 34 including the flange 42 is tapered slightly upwardly from horizontal at approximately 3°. Also, for easy insertion of portion 34 into the opening 28, the forward end of the upper edge of portion 34 is cut off at a relatively sharp angle.

In applying the anti-tip system of the present invention to the appliance, the portions 32 of brackets 26 are secured to the wall 25 at a location both vertically and horizontally wherein the portion 34 aligns with the opening 28 in the rear wall of the cabinet. In its fixed location the underside of flange 42 forming the stop surface should be at a height wherein minimum clearance is present between flange 42 stop surface and the lower edge 46 of the opening 28 which forms the cabinet stop surface. In this orientation a minimum amount of tilting or rotation of the cabinet is permitted before contact between the stop surfaces of the bracket 26 and cabinet 12 engage to prevent further movement of the cabinet. The length of portion 34 is such that it assures engagement with the opening 28 if the appliance is spaced within approximately eight inches from the wall. The location of the opening 28 generally between the outer cabinet side wall 11 and the oven liner 23 allows free movement of portion 34 therebetween. The placement of the openings 28 adjacent the corner bend of the cabinet intersecting rear wall 13 and side walls of the cabinet 12 affords additional strength. Further, by locating the opening 28 in the lower quarter of the appliance it insures greater resistance to the tipping forces. Since the portion 34 extends from the portion 32 approximately eight inches, the anti-tip system of the present invention is effective or operative in the event the appliance is not against the wall 25.

In summary, the present arrangement provides an effective anti-tipping system when the appliance is arranged in its selected position and the wall mounted brackets are received in the appliance openings. At the same time the system allows movement of the appliance away from the wall independent of the anti-tip system. In its operative position the flange 42 should be juxtaposed of the lower edge of the opening 28 so as to insure minimum tilting movement of the appliance.

It should be apparent to those skilled in the art that the embodiment described heretofore is considered to be the presently preferred form of this invention. In accordance with the Patent Statues, changes may be made in the disclosed apparatus and the manner in which it is used without actually departing from the true spirit and scope of this invention.

What is claimed is:

1. Apparatus for preventing tilting of an appliance relative to a wall, comprising:

an outer appliance cabinet having side walls, a front wall provided with a closure member movable from a closed generally vertical position to an open generally horizontal position, and a rear wall including receiving apertures adjacent each of said side walls;

a rigid support member including a first wall engaging portion having a substantially flat rear side, and a second portion extending substantially perpendicular from said first portion, a first stop means on the lower edge of said second portion;

a plurality of fasteners extending through said first wall portion of said support member and into said wall; and a second stop means on the lower end of said receiving aperture being aligned to engage said first stop means when said appliance is positioned adjacent said wall for thereby preventing upward movement of said rear wall of said appliance cabinet and tilting of said appliance relative to said wall.

2. The apparatus recited in claim 1 wherein said wall is of the type having a plurality of spaced vertically positioned frame members, and said first wall engaging portion having a length greater than said space between said frame members so as to insure engagement of said fastener with at least one of said spaced frame members.

3. The apparatus recited in claim 2 wherein said first stop means on the lower edge of said second portion of said rigid support member is formed by an inwardly extending flange portion on said lower edge.

4. The apparatus recited in claim 3 wherein said first wall engaging portion includes a pair of substantially parallel rows of horizontally extending openings whereby said fasteners extend through selected ones of said openings.

5. The apparatus recited in claim 4 wherein said first stop means on the lower edge of said second portion inclines upwardly from a position adjacent said first wall engaging portion.

* * * * *